United States Patent [19]

Smith et al.

[11] Patent Number: 4,934,277

[45] Date of Patent: Jun. 19, 1990

[54] MOBILE AERIAL RAPID RESCUE SYSTEM

[75] Inventors: Flint K. Smith; Robert T. Cunningham, both of Aspen, Colo.

[73] Assignee: Evacuation Systems, Inc., Aspen, Colo.

[21] Appl. No.: 423,611

[22] Filed: Oct. 16, 1989

Related U.S. Application Data

[63] Continuation of Ser. No. 281,929, Dec. 6, 1988, abandoned, which is a continuation of Ser. No. 69,348, Jul. 2, 1987, abandoned.

[51] Int. Cl.[5] ..... B61B 12/02

[52] U.S. Cl. ..... 104/113; 182/11; 182/72

[58] Field of Search ..... 104/113; 182/11, 72

[56] References Cited

U.S. PATENT DOCUMENTS

| | | | |
|---|---|---|---|
| 301,923 | 7/1884 | Reisdorff | 104/113 X |
| 654,687 | 7/1900 | Suter | 104/112 X |
| 1,684,251 | 9/1928 | Thomas | 104/113 X |
| 1,935,711 | 11/1933 | Hecox et al. | 104/113 X |

FOREIGN PATENT DOCUMENTS

| | | | |
|---|---|---|---|
| 2035933 | 1/1972 | Fed. Rep. of Germany | 104/113 |
| 2415837 | 10/1974 | Fed. Rep. of Germany | 104/113 |
| 2285277 | 4/1976 | France | 104/113 |
| 563314 | 10/1977 | U.S.S.R. | 104/113 |
| 1297772 | 11/1972 | United Kingdom | 104/113 |

*Primary Examiner*—Andres Kashnikow
*Assistant Examiner*—Virna Lissi Mojica
*Attorney, Agent, or Firm*—Michael, Best & Friedrich

[57] ABSTRACT

A rescue device for use in traversing a cable of an aerial transportation system, the rescue device including a frame carried by a pair of wheels for movement along the cable, the frame including a portion extending below the cable, and a lever arm having opposite ends and being pivotally connected intermediate its opposite ends to the downwardly extending portion of the frame. A suspension device such as a harness is attached to one end of the lever arm and is intended to support the rescuer. A brake pad or shoe is mounted on the opposite end of the lever arm and is positioned below the cable. The weight of the rescuer on the harness functions to cause engagment of the brake pad with the cable. A brake control lever projects from the end of the lever arm supporting the brake pad and is pulled downwardly by the rescuer to control the force of the brake pad against the cable.

10 Claims, 2 Drawing Sheets

3
3
4
4

MOBILE AERIAL RAPID RESCUE SYSTEM

This is a continuation of application Ser. No. 281,929 Pat No. 4,312 Col. No. 1
continuation of then co-pending application Ser. No. 069,348 filed on July 2, 1987, now abandoned.

FIELD OF THE INVENTION

The present invention is directed to apparatus for use in evacuating aerial transportation systems that use a wire rope or cable as the primary drive and support mechanism. More particularly, the invention relates to apparatus for permitting rescue personnel to traverse the length of the cable in a rescue operation to evacuate people from chairs or cars supported by the cable.

BACKGROUND PRIOR ART

Aerial transportation systems of the type including a wire cable as the primary drive or support mechanism are used as ski lifts, oil derrick escape mechanisms, portable escape systems, gondolas, aerial trams, and in mining systems, etc. Such aerial transportation systems for use in carrying people commonly require standby evacuation equipment such that in the event the cable drive is interrupted or the aerial transportation system becomes otherwise inoperable, the persons carried by the chairs, cable cars or gondolas can be lowered to the ground. For example, regulations by the Colorado Tramway Board require evacuation equipment capable of evacuating all persons from a four person ski lift within a period of two hours.

In some prior art ski lift evacuation systems, the rescuer stands on the ground and throws a rope over the cable. Evacuees are then supported on a T-bar apparatus or in a sling or harness and lowered to the ground. In other prior arrangements, a rescuer may be supported on a device which can descend the cable. A second rescuer on the ground handles a rope connected to the device and accompanies the first rescuer, as the first rescuer moves along the length of the cable. The rescuer on the ground aids the suspended rescuer and controls the speed of his descent along the cable and also aids in lowering persons from chairs or cars to the ground.

SUMMARY OF THE INVENTION

The present invention provides an improved apparatus for use in supporting a rescuer for movement along a cable. The apparatus embodying the invention permits a rescuer to move along a cable independently or without help from a second rescuer on the ground. The apparatus also provides for smooth and secure movement of the rescuer along the cable while also providing a positive means for braking. The device for supporting the rescuer also can be easily attached to the cable, comprises an apparatus of relatively simple construction and also includes a minimum number of component parts.

More specifically, the rescue device embodying the invention includes a frame carried by a pair of wheels for movement along the cable. The frame includes a portion extending below the cable and a lever arm having opposite ends, and the lever being pivotally connected intermediate its opposite ends to the downwardly extending portion of the frame. A suspension device such as a harness is attached to one end of the lever arm and is intended to support the rescuer. A brake pad or shoe is mounted on the opposite end of the lever arm and is positioned below the cable. The weight of the rescuer on the harness functions to cause engagement of the brake pad with the cable. A brake control lever projects from the end of the lever arm supporting the brake pad and is pulled downwardly by the rescuer to control the force of the brake pad against the cable.

One of the advantages of the rescue device of the invention is that a single rescuer can operate the cable traverse device without the aid of a second rescuer on the ground. The device is easily operated and can move quickly along the length of the cable from one gondola or chair to the next to thereby facilitate rapid evacuation of persons from the aerial lift system.

Another advantage of the invention is that the weight of the person carried by the traverse device functions to provide a positive braking force against the cable, to thereby provide a secure means for braking the traverse device against movement along a cable.

Another advantage of the invention is that means are provided for facilitating adjustment of the position of components of the device to permit use by persons of different weight.

Various other features and advantages of the invention will be apparent by reference to the following description of a preferred embodiment, from the drawings and from the claims.

Figure 1:
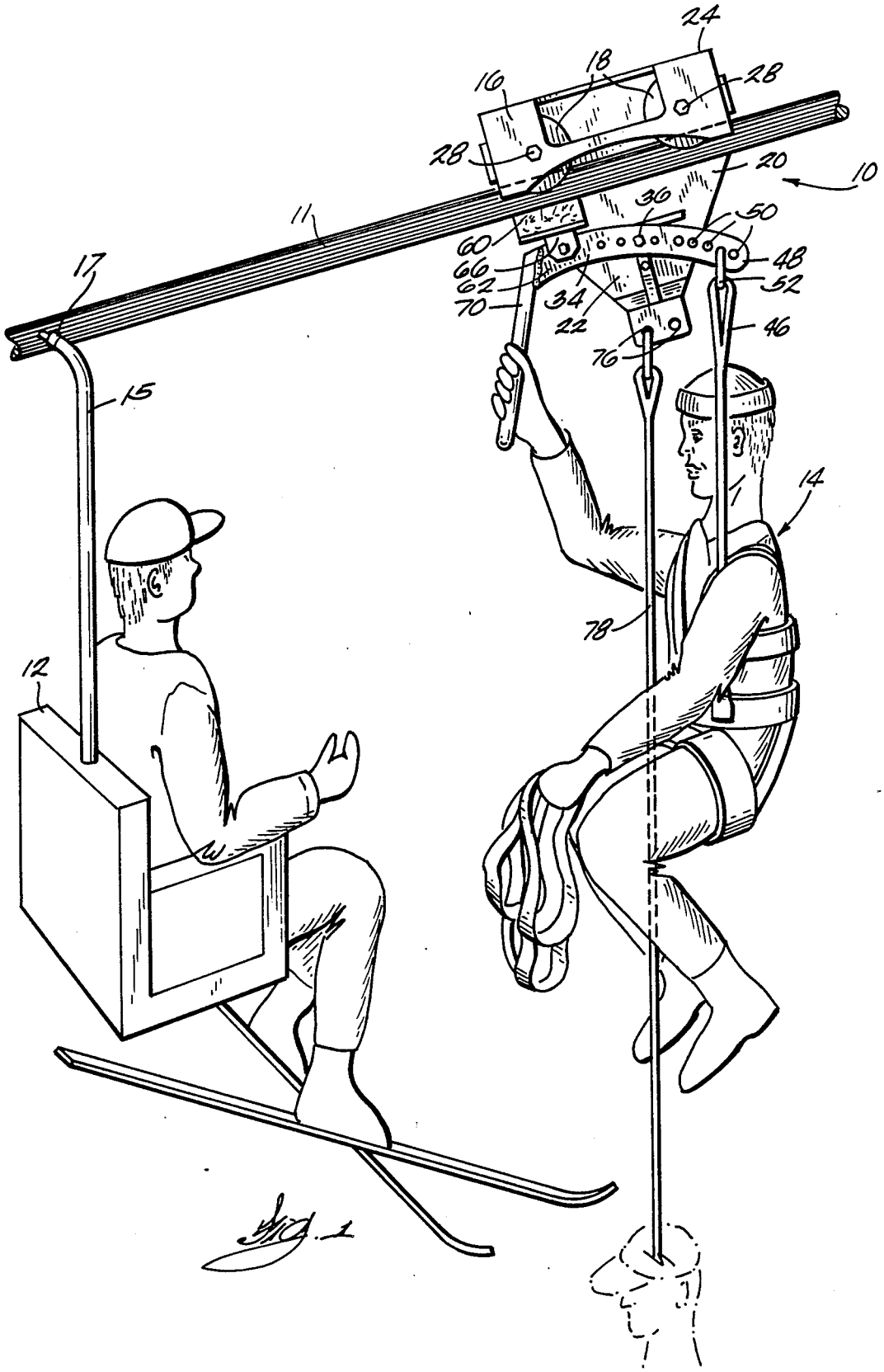
FIG. 1 is an elevation view of the cable traverse device of the invention supported on a cable and carrying a rescuer.

Before explaining one embodiment of the invention in detail, it is to be understood that the invention is not limited in its application to the details of construction and the arrangements of the components set forth in the following description or illustrated in the drawings. The invention is capable of other embodiments and of being practiced or being carried out in various ways. Also, it is to be understood that the phraseology and terminology used herein is for the purpose of description and this invention, within the scope of the appended claims, can take forms other than specifically illustrated and described.

DESCRIPTION OF A PREFERRED EMBODIMENT

FIG. 1 illustrates a rescue device 10 for traversing the length of a cable 11 of the type used in supporting gondolas or chairs 12 of a ski lift and for supporting a rescuer 14 for movement along the length of the cable 11. Chair 12 is suspended from cable 11 by rod 15. In a conventional manner, rod 15 has a pivotal connection to bracket 17 and bracket 17 is spliced or otherwise embedded in cable 11. In this manner, the chair is securely supported from the cable but is free to swing in a vertical plane about the pivotal connection to bracket 17.

The rescue device 10 includes a frame 16 which is supported by a pair of wheels 18 adapted to ride on the cable 11 and to support the frame 16 for movement along the length of the cable. The frame 16 includes a generally vertical rearward plate portion 20 defining a generally vertical plane. A lower portion 22 of the plate portion 20 extends downwardly below the cable 11. The frame 16 also includes a forward plate portion 24, the forward and rearward plate portions 24 and 20 being rigidlY joined together at their upper edges by a web portion 26 of the frame. The wheels 18 are housed in the frame 16 between the forward and rearward plate portions 24 and 20, the wheels 18 being supported on a pair of axles 28 and being spaced apart in the direction of the longitudinal axis of the cable 11. The wheels 18 are mounted on the axles 28 so as to be freely rotatable. In the illustrated embodiment of the invention the wheels each include a peripherally extending groove 30 complementary to the shape of the cable 11.

A lever arm 34 is pivotally joined to the lower portion 22 of the plate below the cable and for pivotal movement about an axis parallel to the axis of rotation of the wheels. While the lever arm 34 could be connected to the lower portion 22 of the rearward plate 20 in various ways, in the illustrated arrangement a bolt 36 extends through a central portion the lever arm 34 and through a bore provided in the rearward plate. In the illustrated construction the lower portion 22 of the plate 20 is reinforced by a generally "T" shaped gusset 38 projecting from the forward face 40 of the lower portion 22 of the plate 20. A plurality of vertically spaced apart holes or bores 42 extend through the vertical gusset and through the plate 20 to accommodate the bolt 36. The bolt 36 may be selectively housed in one of the bores 42 and secured in place by nut 37.

Means are also provided for suspending the rescuer for movement along the cable 11, this means including a sling or harness assembly 46 for carrying the rescuer, the sling assembly 46 being connected to one end 48 of the lever arm 34. In the illustrated embodiment, a plurality of holes 50 are provided in the end 48 of the lower arm 34, the holes 50 being spaced apart in the direction away from the pivot axis of the lever arm 34, and the sling assembly 46 can be connected to the lever arm 34 by a link or hook 52, either fixed or releasable, housed in a selective one of the holes 50. As illustrated, the hook 52 may be removed from lever arm 34 by pressing spring loaded portion 53 inwardly, a conventional construction. In a preferred form of the invention, the sling assembly 46 includes a leather harness constructed to form a seat for the rescuer.

Brake means are also provided for engaging the cable to selectively control the speed of the rescue device 10 as it moves along the length of the cable 11, or stop it at a desired point. The brake means includes a brake shoe or pad 60 fixedly supported by an upper portion of an end 62 of the lever arm 34 opposite the end 48 of the lever arm 34 supporting the sling. In the particular embodiment of the invention shown in the drawings, an upper edge of the lever arm supports a bracket 66, and the bracket 66 rigidly supports the brake shoe 60, the brake shoe 60 being supported for generally vertical movement toward and away from the cable 11 in response to pivotal movement of the lever arm 34, and such that downward movement of the end 48 of the lever arm 34 will cause upward movement of the brake shoe 60 into engagement with the cable 11.

The lever arm 34 also includes a projecting end portion 70 functioning as a handle and adapted to permit the rescuer to control the pressure of the brake shoe or pad 60 on the cable 11. As illustrated in FIG. 1, the handle 70 projects forwardly and downwardly and is positioned such that when the rescuer pulls downwardly on the handle 70, the brake shoe 60 is pulled away from the cable.

In operation of the apparatus, the weight of the rescuer on the end of the lever arm 34 will tend to cause clockwise pivotal movement of the lever arm 34, as seen in FIG. 1, and upward movement of the brake shoe 60 into engagement with the cable to thereby brake the movement of the rescue device. If the operator pulls downwardly on the end of the handle 70, the brake shoe 60 is pulled away from the cable and the rescue device will be freely movable along the length of the cable 11, with the downward force on the handle by the operator determining the speed at which the rescue device will move along the cable.

In the illustrated arrangement the lower end 22 of the plate 20 is also provided with a pair of holes 76 provided to permit attachment of line 78 used to lower persons from a chair to the ground. Line 78 is connected to plate end 22 by hook 80 similar in construction to hook 52.

With the construction of this invention, the rescuer can safely move along the suspension cable at a controlled speed regardless of the angle or inclination of the support cable. In the ski lift application, the rescuer lowers himself to the stalled chair. Once there, he can release lever 70 and his weight holds the brake set as he lowers the chair occupants to the ground.

Figures 2, 3, 4:
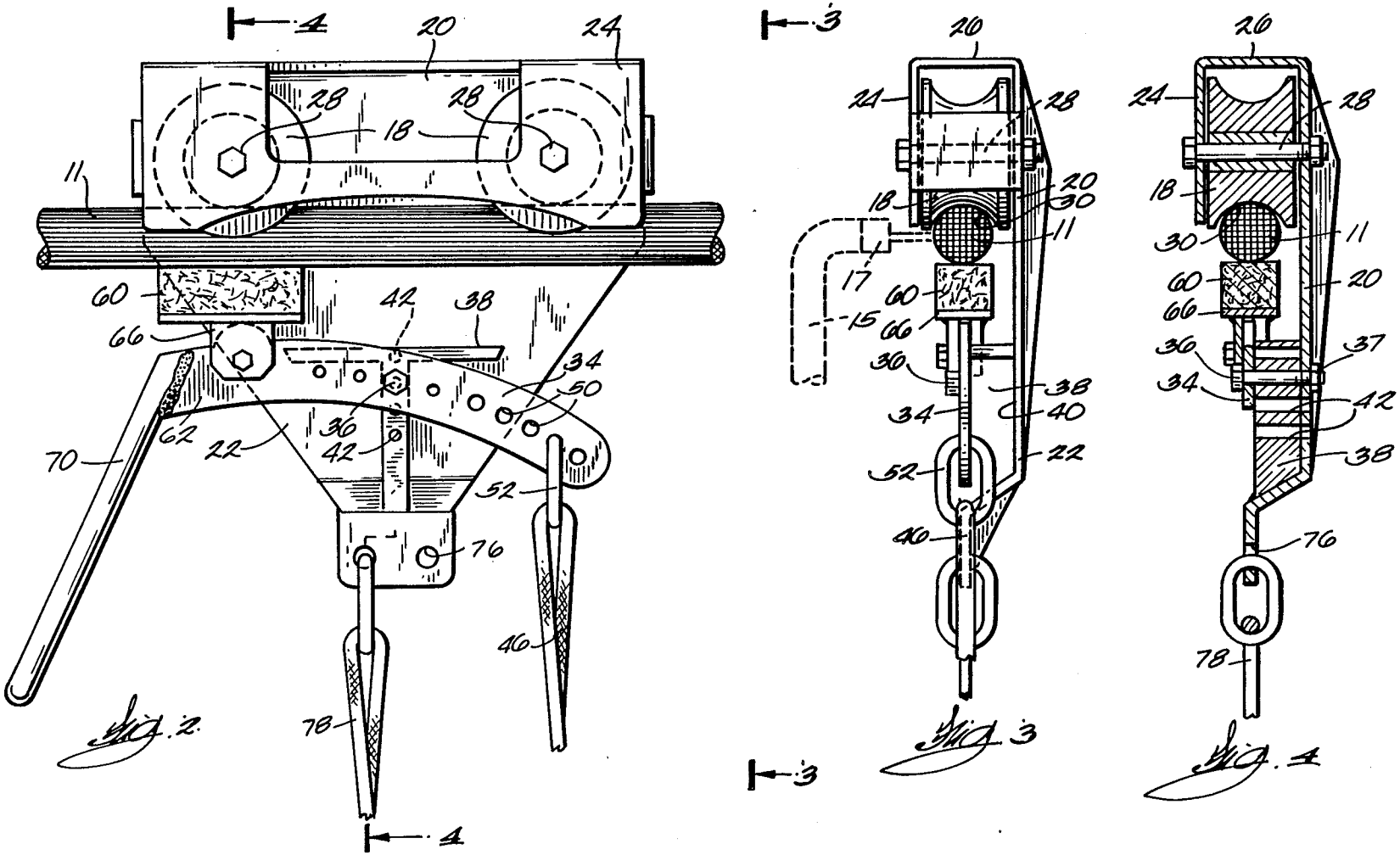
FIG. 2 is an enlarged partial view of apparatus illustrated in FIG. 1.
FIG. 3 is an end view taken along line 3—3 in FIG. 2.
FIG. 4 is a cross section view taken along line 4—4 in FIG. 2.

After the chair is cleared of occupants, he can release the brake and move down to the next chair. The chair support is shown in dotted lines in FIG. 3 to show the relationship of the carrier parts to the cable and chair support. As can be seen in FIGS. 2, 3, and 4, with the lowermost extension of leg 24 terminating in the area of the periphery of wheels 18 and with the open nature of the carrier, the carrier can ride over and past the chair connection to the cable. The periphery of wheels 18 will clear the bracket 17 or, if there is engagement, roll over it, or any other conventional cable clamp that is used, without disengaging from the cable. Also, the rescuer can swing the chair and its support out of his path as he rolls by. In the preferred embodiment, the open nature is provided by the planar rear plate which terminates in an inverted U-shaped end completed by plates 24 and web 26 with the wheels 18 supported in the open end of U. This open construction will also allow the carrier to readily roll over the cable support pulleys at most chair lift support towers. When used with a gondola installation, the carrier will roll over the cable support pulleys at the support towers. At the gondola, the rescuer will detach the carrier from the cable, evacuate the gondola, and then traverse the gondola, reattach the carrier to the cable and proceed down to the next gondola. At any support tower where the carrier will not roll over the cable pulleys, the carrier is removed from the cable, the rescuer traverses the tower, reattaches the carrier and proceeds down the cable. The open construction of the carrier allows it to be easily attached to and released from the cable.

Various features of the invention are set forth in the following claims:

We claim:

1. A rescue device for supporting rescue personnel for movement along the length of a cable, the apparatus comprising:

at least one wheel adapted to be supported on the cable and to roll along the length of the cable, a frame, said frame having a web and first and second generally parallel legs connected by said web and depending from said web in relatively spaced relation and located one on each side of said wheel and rotatably supporting said wheel therebetween, said first frame leg having a lower termination in the area of the periphery of said wheel and a second frame leg extending downwardly below said first leg, a lever arm having opposite ends, means located below said wheel and connected to said lever arm and said second leg of said frame but free from said first leg for supporting said lever arm for pivotal movement on said second leg and about a pivot axis intermediate its opposite ends so that said frame and wheel are movable along said cable and said first leg will pass above and not interfere with lateral attachments extending from said cable and so that said rescue device has a generally open construction relative to said cable and can be readily positioned on said cable by moving said rescue device over and then down on said cable without interference and can be readily removed from said cable by the reverse procedure, suspension means for supporting a person, said suspension means being connected to one end portion of said lever arm, brake means for selectively engaging the cable to brake the movement of the rescue device along the length of the cable, the brake means being supported by the lever arm on the opposite side of said pivot axis from said suspension means, and said brake means facing upwardly from said lever arm toward said wheel and being supported for movement by said lever between a cable engaging position and a brake release position, and a brake control lever connected to the opposite end of the lever arm and accessible to rescue personnel in said suspension means, said cable brake control lever movable by the rescue personnel between a position wherein the brake is engaged with the cable to brake the apparatus and a brake release position, so that the weight of rescue personnel in said suspension means urges said brake means into engagement with said cable and a force on said brake control lever moves said brake means away from said cable.

2. Apparatus as set forth in claim 1 wherein the suspension means includes a harness for supporting a rescue person and means for attaching the harness to the one end of the lever arm.

3. Apparatus as set forth in claim 1 and further including means for selectively attaching said suspension means to said lever arm at a selected location from the pivot point of the lever arm.

4. A rescue device for supporting rescue personnel for movement along the length of a cable, the apparatus comprising:

at least one wheel adapted to be supported on the cable and to roll along the length of the cable, a frame, said frame having a web and first and second generally parallel legs connected by said web and depending from said web in relatively spaced relation and located one on each side of said wheels and rotatably supporting said wheels therebetween, said first frame leg having a lower termination in the area of the periphery of said wheels and a second frame leg extending downwardly below said first leg so that said frame and wheels are movable along said cable and said first leg will pass above and not interfere with lateral attachments extending from said cable and so that said rescue device has a generally open construction relative to said cable and can be readily positioned on said cable by moving said rescue device over and then down on said cable without interference and can be readily removed from said cable by the reverse procedure, a lever arm having opposite ends, the lever arm being pivotally connected to said second leg of said frame and located below said wheel, the lever arm being pivotally movable about a pivot axis intermediate its opposite ends, suspension means for supporting a person, said suspension means being connected to one end portion of said lever arm, brake means for selectively engaging the cable to brake the movement of the rescue device along the length of the cable, the brake means being supported by the lever arm on the opposite side of said pivot axis from said suspension means, and said brake means facing upwardly from said lever arm toward said wheel and being supported for movement by said lever between a cable engaging position and a brake release position, a brake control lever connected to the opposite end of the lever arm and accessible to rescue personnel in said suspension means, said cable brake control lever movable by the rescue personnel between a position wherein the brake is engaged with the cable to brake the apparatus and a brake release position, so that the weight of rescue personnel in said suspension means urges said brake means into engagement with said cable and a force on said brake control lever moves said brake means away from said cable, means for releasably connecting said lever to said frame at a selective one of a plurality of positions spaced along the length of said lever, and means for releasably connecting said lever to said frame at a selective one of a plurality of relatively vertically spaced positions on said frame.

5. Apparatus as set forth in claim 1 wherein the pivot axis of said lever arm is parallel to the axis of rotation of the wheel.

6. Apparatus as set forth in claim 1 wherein said brake control lever extends in the direction of movement of the apparatus along the cable and downwardly and includes a projecting end comprising a handle adapted to be gripped by the rescue person.

7. Apparatus as set forth in claim 1 and further including a second wheel supported in said frame in the same manner as said first mentioned wheel, said wheels being spaced apart in the direction of the longitudinal axis of said cable, and said wheels being supported on said cable and being rotatable about axles connected between said first and second frame legs, and said pivot axis of said lever arm being below said wheels and intermediate said wheels.

8. Apparatus as set forth in claim 1 including a second wheel supported in said frame in the same manner as said first mentioned wheel and spaced from said first wheel in the direction of the longitudinal axis of said cable, wherein said frame includes a generally vertical planar wall connected to said second frame leg and terminating in a generally U-shaped end opening down toward said lever, said wheels being supported at the open end of said U-shaped opening and said lever being supported from said planar wall below said wheels, and said brake means making braking engagement with said cable against one of said wheels.

9. A rescue device for supporting rescue personnel for movement along the length of a cable, the apparatus comprising:

first and second wheels relatively spaced in the direction of the longitudinal axis of said cable and adapted to be supported on the cable and to roll along the length of the cable, a frame, said frame having a web and first and second generally parallel legs connected by said web and depending from said web in relatively spaced relation and located one on each side of said wheels and rotatably supporting said wheels therebetween, said first frame leg having a lower termination in the area of the periphery of said wheels and a second frame leg extending downwardly below said first leg so that said frame and wheels are movable along said cable and said first leg will pass above and not interfere with lateral attachments extending from said cable and so that said rescue device has a generally open construction relative to said cable and can be readily positioned on said cable by moving said rescue device over and then down on said cable without interference and can be readily removed from said cable by the reverse procedure, a lever arm having opposite ends, the lever arm being pivotally connected to said second leg of said frame and located below said wheel, the lever arm being pivotally movable about a pivot axis intermediate its opposite ends, suspension means for supporting a person, said suspension means being connected to one end portion of said lever arm, brake means for selectively engaging the cable to brake the movement of the rescue device along the length of the cable, the brake means being supported by the lever arm on the opposite side of said pivot axis from said suspension means, and said brake means facing upwardly from said lever arm toward said wheel and being supported for movement by said lever between a cable engaging position and a brake release position, a brake control lever connected to the opposite end of the lever arm and accessible to rescue personnel in said suspension means, said cable brake control lever movable by the rescue personnel between a position wherein the brake is engaged with the cable to brake the apparatus and a brake release position, so that the weight of rescue personnel in said suspension means urges said brake means into engagement with said cable and a force on said brake control lever moves said brake means away from said cable, means comprising a plurality of openings in said lever and releasable means connected to said frame and engaged in one of said openings to define the pivot point of said lever from said frame, said openings being relatively spaced apart in a direction between the opposite ends of said lever so that the point of pivot support of the lever from the frame can be varied along the length of said lever, and means on said frame releasably receiving said first mentioned releasable means and comprising a plurality of vertically spaced openings with said first mentioned releasable means being received in one of said vertically spaced openings so that the vertical position of said lever on said frame can be varied.

10. Apparatus as set forth in claim 9 including a generally vertical planar wall connected to said second frame leg and forming the lower extension thereof, and wherein said vertical openings on said frame are provided on said planar wall.

* * * * *